US005464695A

United States Patent [19]

Kawamoto et al.

[11] Patent Number: 5,464,695

[45] Date of Patent: Nov. 7, 1995

[54] COMPOSITE FIBER CONTAINING INORGANIC FINE POWDER

[75] Inventors: Masao Kawamoto; Kazuhiko Tanaka; Kiyoshi Hirakawa, all of Kurashiki; Eiichirou Nakamura, Takatsuki, all of Japan

[73] Assignee: Kuraray Company Limited, Kurashiki, Japan

[21] Appl. No.: 395,201

[22] Filed: Feb. 27, 1995

Related U.S. Application Data

[63] Continuation of Ser. No. 173,483, Dec. 27, 1993, abandoned, which is a continuation of Ser. No. 918,013, Jul. 24, 1992, abandoned.

[30] Foreign Application Priority Data

Jul. 25, 1991 [JP] Japan ..... 3-209805
Aug. 1, 1991 [JP] Japan ..... 3-216439

[51] Int. Cl.[6] ..... D02G 3/00

[52] U.S. Cl. ..... 428/370; 428/373; 428/374; 524/350

[58] Field of Search ..... 428/370, 374, 428/373; 524/350

[56] References Cited

U.S. PATENT DOCUMENTS

| | | | |
|---|---|---|---|
| 3,285,855 | 11/1966 | Dexter et al. | 252/57 |
| 3,860,675 | 1/1975 | Pampus et al. | 524/350 |
| 4,824,883 | 4/1989 | Walter et al. | 524/350 |
| 4,829,115 | 5/1989 | Cottman | 524/350 |
| 5,047,448 | 9/1991 | Tanaka et al. | 523/122 |
| 5,164,434 | 11/1992 | Linak et al. | 524/350 |

FOREIGN PATENT DOCUMENTS

| | | |
|---|---|---|
| 0107616 | 9/1983 | European Pat. Off. . |
| 0285437 | 3/1988 | European Pat. Off. . |
| 2-289118 | 11/1990 | Japan . |
| 02289118 | 11/1990 | Japan . |

OTHER PUBLICATIONS

Section Ch,Wk 9227, Derwent Publ Ltd London, GB; Class A, AN 92–224107 & JP–A–4 153 May 26, 1992.
Section CH,Wk 8642, Derwent Publ, London, GB; Class A, AN 86–229142 & JP–A–61 159 442 Jul. 19, 1986.
Taschenbuch Der Kunststoff–Additive/R. Gchter & H. Mller, 3rd ed., 1989, Part I "Antioxidantien". . . .
JA A228911, Nov. 29, 1990—only Example 1 was submitted.

*Primary Examiner*—N. Edwards
*Attorney, Agent, or Firm*—Oblon, Spivak, McClelland, Maier & Neustadt

[57] ABSTRACT

A composite fiber having a single filament fineness of not more than 8 deniers and comprising:

a hydrogenation product of a block copolymer comprising poly(vinylaromatic) blocks and poly(conjugated diene) blocks and containing a specific phenol-based compound and a large amount of an inorganic fine powder and a fiber-forming polymer; this composite fiber has, in spite of a large content of the inorganic fine powder and its small fineness, excellent spinnability upon its production and excellent processability after spinning, as well as excellent fiber properties.

6 Claims, 1 Drawing Sheet

COMPOSITE FIBER CONTAINING INORGANIC FINE POWDER

This is a Continuation of application Ser. No. 08/173,483, filed on Dec. 27, 1993, now abandoned which is a Continuation of Ser. No. 07/918,013 filed Jul. 24, 1992 (abandoned).

BACKGROUND OF THE INVENTION

1. Field of the Invention

The present invention relates to a fiber containing a large amount of inorganic fine powder, such as ultraviolet ray-shielding fiber or conductive fiber, and, in spite of its high content of the inorganic fine powder, having a fineness of not more than 8 deniers and being obtainable with stable spinning operation.

2. Description of the Prior Art

There has been used in recent years a process for providing fibers with various properties, which comprises kneading into a fiber-forming polymer an inorganic powder selected depending on the property to add, and then spinning the obtained composition into a fiber. For example, a white conductive fiber is obtained by kneading an inorganic powder of a white conductive metal oxide into a polymer and spinning the obtained composition. In another case, an inorganic powder of an ultraviolet ray-shielding inorganic powder is selected and kneaded into a fiber-forming polymer and the obtained composition is spun, to give an ultraviolet ray-shielding fiber. Further an inorganic powder of a specific pigment may be selected and kneaded into a fiber-forming polymer to give a composition, which is then spun into a spun-dyed fiber having a specific color.

It is however necessary in these fibers containing inorganic fine powder that the amount of the fine powder added be in a high level to produce the effect of the addition sufficiently. With, for example, white conductive fibers, an addition of a white conductive metal oxide in an amount below a specific level cannot connect the metal oxide particles linearly to produce conductive property. Likewise, too low an amount of an ultraviolet ray-shielding inorganic fine powder cannot produce a satisfactory ultraviolet ray-shielding effect. Such being the cases, there has been desired a technique that can add inorganic fine powders in large amounts.

In general, a large amount of inorganic fine powder incorporated into a polymer causes to rapid deterioration of the spinnability of the polymer. Furthermore, a large amount of inorganic powder exposed on the fiber surface scrapes away the surfaces of guides, rolls, drawing plates, travellers arranged in the fiber manufacturing equipment, thereby rendering it impossible to use these apparatuses any longer. Prolonged use of these surface-worn apparatuses will cause frequent fiber breakage and generation of many fluffs. Where a large amount of an inorganic powder is to be incorporated into a fiber, the inorganic powder should therefore be not present on the fiber surface. For this purpose one may figure out a process which comprises incorporating an inorganic powder into a polymer and producing a sheath-core composite fiber, while permitting the obtained polymer composition to constitute the core. In this case, however, it be6comes necessary to add still larger amount of inorganic powder to the core-component polymer, i.e. only part of the entire fiber, in order to produce a sufficient effect of addition for the entire fiber. Then, the still larger addition amount renders it more difficult to spin or thread the resulting core-component polymer composition stably.

To increase the spinnability of a core-component polymer containing a large amount of an inorganic powder, there is proposed use of thermoplastic elastomers as that polymer (Japanese Patent Application Laid-open No. 289118/1990). This technique comprises using as an inorganic fine powder a conductive metal oxide fine powder and as a core-component polymer a polystyrene-polyisoprene-polystyrene block copolymer, a polystyrene-polybutadiene-polystyrene block copolymer, polystyrene-polyisoprene block copolymer or hydrogenation products of the foregoing, whereby the core-component polymer containing a large amount of the conductive metal oxide powder exhibits good spinnability.

It is true that this technique can produce with no problem composite fibers with, however, a limitation that their finenesses should be at least 10 deniers. It is difficult with this technique to produce stably, in a high yield and with satisfactory quality, finer fibers with 8 deniers or below which is generally adopted as the fineness for fibers for clothing use. Besides, fibers containing a large amount of inorganic fine powder develop, when dyed, not so deep colors or bright colors, thereby failing to give finished fabrics having a color of high-grade feeling.

SUMMARY OF THE INVENTION

Accordingly, an object of the present invention is to provide a fiber having a fineness of not more than 8 deniers, i.e. a fineness suitably employed for clothing-use fibers, and being obtainable with excellent spinnability and having excellent fiber properties including development of bright color upon dyeing.

Serious problems encountered upon attempting to incorporate a large amount of an inorganic fine powder into a fiber include, above all, deterioration of spinnability in the spinning process due to filter clogging, filament breakage and other troubles. Next comes, even if spinning has been made, frequent filament breakage during drawing process. Drawn fibers still cause problems during post-processing such as weaving and knitting, in particular wear of guides and the like. Further the obtained fibers may have poor uniformity.

In the present invention, the above problems have been solved by the use, as a polymer to contain inorganic fine powders in high concentrations, of a specific block copolymer containing a specific compound.

Thus, the present invention provides a composite fiber having a single filament fineness of not more than 8 deniers and comprising a protective polymer component (A) comprising a fiber-forming thermoplastic polymer and a polymer component (B) containing an inorganic fine powder, said component (A) being exposed on at least 60% of the circumference of the cross-section of said fiber and said component (B):

(I) containing said inorganic fine powder in an amount of 5 to 85% by weight based on the total weight of component (B), (II) containing at least 0.1% by weight based on the weight of the polymer constituting component (B) of a hydroxy-tert-butylphenyl compound with its hydroxy group present at the ortho-position relative to the tert-butyl group, and (III) comprising a block copolymer, said block copolymer having a number average molecular Weight of 30,000 to 250,000 and comprising units from a poly(vinylaromatic) block having a number average molecular weight of 4,000 to 50,000 and units from a poly(conjugated diene) block having a number average molecular weight of 10,000 to 150,000, at least 30% of the double bonds based on the conjugated diene of said poly(conjugated diene) block being hydrogenated.

BRIEF DESCRIPTION OF THE DRAWINGS

A more complete appreciation of the invention and many of the attendant advantages thereof will be readily obtained as the same become better understood by reference to the following detailed description when considered with the accompanying drawings, wherein.

DESCRIPTION OF THE PREFERRED EMBODIMENTS OF THE INVENTION

Figure 1:
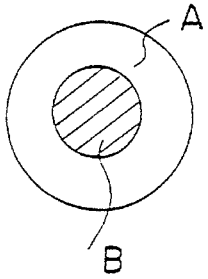
FIGS. 1 through 8 are cross-sectional views of examples of the composite fiber of the present invention, where A indicates a protective polymer component comprising a fiber-forming thermoplastic polymer and B indicates a polymer component containing an inorganic fine powder and a hydroxy-tert-butylphenyl compound.

Examples of the compound forming the poly(vinylaromatic) block, that is the first consitituent of the block copolymer used in the present invention are styrene, 1-vinylnaphthalene, 2-vinylnaphthalene, 3-methylstyrene, 4-propylstyrene, 4-cyclohexylstyrene, 4-dodecylstyrene, 2 -ethyl-4-benzylstyrene and 4-(phenylbutyl)styrene. These compound may be used singly or in combination.

Examples of the compound forming the poly(conjugated diene), that is the second constituent of the block copolymer, are isoprene, butadiene and piperine. These compounds may also be used singly or in combination.

The block copolymer used in the present invention, principally comprising poly(vinylaromatic) blocks and poly-(conjugated diene) blocks, may have in the molecular chain or on the molecular terminus thereof functional groups such as carboxyl group, hydroxyl group and anhydride.

Concrete examples of the block copolymer used in the present invention are, for example, hydrogenation products of polystyrene-polybutadiene-polystyrene block copolymers (hereinafter referred to as SBS), hydrogenation products of polystyrene-polyisoprene-polystyrene block copolymer (hereinafter referred to as SIS), hydrogenation products of polystyrene-polyisoprene block copolymers (hereinafter referred to as SI), hydrogenation products of poly(α -methylstyrene-polyisoprene-poly(α-methylstyrene) block copolymers, hydrogenation products of poly(α-methylstyrene-polybutadiene-poly(α-methylstyrene) block copolymers and hydrogenation products of poly(α-methylstyrene)-polyisoprene block copolymers. Particularly preferred among the above are hydrogenation products of tri-block copolymers having a poly(vinylaromatic) block as each of their terminal block, among which the above hydrogenation products of SIS are more particularly preferred.

It is necessary that in the block copolymer used in the present invention at least 30% of $th_e$ double bonds based on the conjugated diene of the poly(conjugated diene) be hydrogenated. If the hydrogenation ratio is less than 30%, the block copolymer will thermally decompose upon melt spinning. The hydrogenation ratio herein means the ratio hydrogenated of the carbon-carbon unsaturated double bonds based on the conjugated dienes contained in the block copolymer. This ratio is obtained by determining the iodine values before and after hydrogenation and calculating the percentage of the latter to the former. The hydrogenation ratio is more preferably at least 50%.

It is necessary that the block copolymer used in the present invention have a number average molecular weight in a range of 30,000 to 250,000. With the number average molecular weight being less than 30,000, the polymer has too low a melt viscosity upon spinning, thereby causing frequent filament breakage and yarn breakage during spinning and forming a fiber with poor uniformity. These problems become more marked where an attempt is made to produce a composite fiber using a protective polymer component having high melting point, such as polyester. On the other hand, with the number average molecular weight exceeding 250,000, the polymer has, in contrast with the above, insufficient melt fluidity and poor spinnability. The number average molecular weight is more preferably within the range of from 40,000 to 200,000. The poly(vinylaromatic) blocks constituting the block copolymer each has a number average molecular weight of 4,000 to 50,000. If the number average molecular weight is less than 4,000, the resulting block copolymer will be of low cohesion strength and poor rubber-like elasticity, whereby its fiber-formation becomes difficult. On the other hand, if the number average molecular weight exceeds 50,000, the block copolymer will have too high a melt viscosity, i.e. low melt fluidity, thereby becoming difficult to spin. The poly(conjugated diene) blocks constituting the block copolymer each has a number average molecular weight of 10,000 to 150,000. If the number average molecular weight is less than 10,000, the resulting block copolymer will have poor elasticity and hardly give the desired fiber. On the other hand, if the number average molecular weight exceed is 150,000, the block copolymer will have low melt fluidity and be hardly spun.

In view of the foregoing, it is desirable that the poly(vinylaromatic) block and the poly(conjugated diene) block have a molecular weight of 5,000 to 40,000 and one of 15,000 to 130,000, respectively. The number average molecular weight is measured by Gel Permeation Chromatograpy (GPC).

The ratio of the poly(vinylaromatic) blocks present in the block copolymer is preferably in a range of 5 to 80% by weight. If the ratio of the poly(vinylaromatic) blocks in the block copolymer is less than 5% by weight, the block copolymer will have low cohesiveness and elasticity and poor handleability, whereby its fiber formation becomes difficult. On the other hand, if the ratio exceeds 80% by weight, the block copolymer will have markedly high viscosity and tend to become difficult to spin.

The block copolymer used in the present invention preferably has a melt flowability as represented by melt flow rate (hereinafter referred to as MFR) of at least 5 g/10 min. If the MFR is less than 5 g/10 min, the melt flowability will deteriorate upon addition of an inorganic fine powder in a high concentration so that it becomes difficult for the block copolymer to give a composite fiber having a fineness of not more than 8 deniers. There are no specific restrictions with respect to the upper limit of the MFR, but it is preferably not more than 100 g/10 min, more preferably in a range of 5 to 80 g/10 min in view of spinnability and productivity. The MFR herein is the value obtained by measurement in accordance with ASTM D1238 and at a temperature of not more than 200° C. and under a load of 10 kg. The MFR defined in the present invention is that of the block copolymer in the fiber obtained by spinning thereof. In this sense, those block copolymers that show an MFR below the above value before spinning but then show satisfactory one during spinning are also suitably used in the present invention.

The MFR of a block copolymer is governed by its molecular weight, the ratio by weight of poly(vinylaromatic) blocks/poly(conjugated diene) blocks, the molecular chain length of each block and the like. For the block copolymer used in the present invention, preferred are those having an MFR in the above range by properly selecting the molecular weight, the ratio by weight between the two constituting blocks, the molecular chain of each of the blocks and the like.

The block copolymer used in the present invention is obtained by the following known processes:

① a process which comprises using an alkyl lithium compound as an initiator and successively polymerizing a compound that forms a poly(vinylaromatic) block and one that forms a poly(conjugated diene) block;

② a process which comprises separately polymerizing a compound that forms a poly(vinylaromatic) block and one that forms a poly(conjugated diene) block and coupling the resulting polymers with a coupler;

③ a process which comprises using a dilithium compound as an initiator and successively polymerizing a compound that forms a poly(vinylaromatic) block and one that forms a poly(conjugated diene) block; and the like.

In the present invention, it is necessary that a hydroxy-tert-butylphenyl compound with its hydroxy group present at the ortho-position relative to the butyl group (hereinafter referred to as "phenol-based compound") be added to the block copolymer in an amount of at least 0.1% by weight based on the weight of the block copolymer. The phenol-based compound is generally used as an antioxidant. While various types of antioxidants other than the phenol-based compound are known, only this compound produces the markedly large effect of stabilizing spinning operation for the block copolymer. Addition of an inorganic powder generally accelerates the thermal decomposition of the block copolymer, which is also markedly suppressed by the phenol-based compound. These functions are considered to help to assure excellent spinnability in spite of incorporation of a large amount of an inorganic powder. The above excellent effect cannot be produced with the phenol-based compound being added in an amount of less than 0.1% by weight. There are no specific restrictions with respect to the upper limit, but the addition is preferably not more than 10% by weight and particularly in a range of 0.2 to 5% by weight.

The phenol-based compound suitably used in the present invention is a compound represented by the following formula (1)

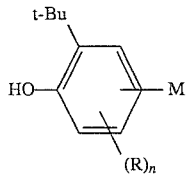

wherein M represents an organic group, R's each represents and alkyl group and n represents an integer of 1 to 3, and R's may be the same or different where n is 2 or more.

Concrete examples of the phenol-based compound are as follows.

(I)

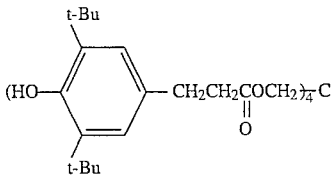

(II)

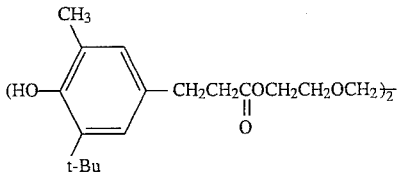

(III)

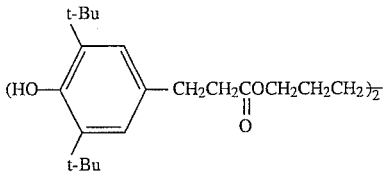

(IV)

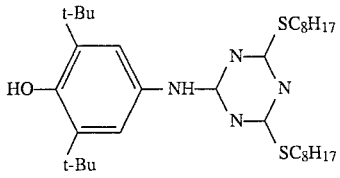

(V)

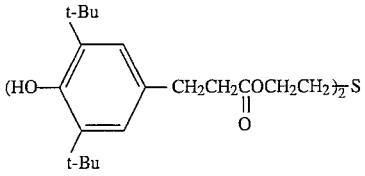

(VI)

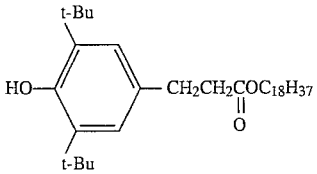

(VII)

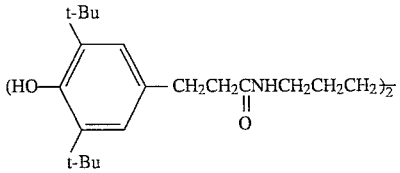

(VIII)

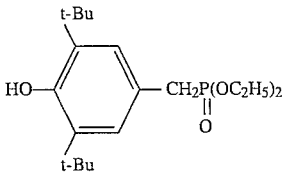

-continued

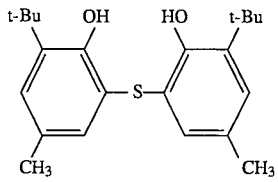

(IX)

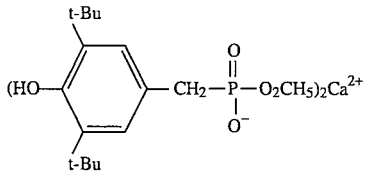

(X)

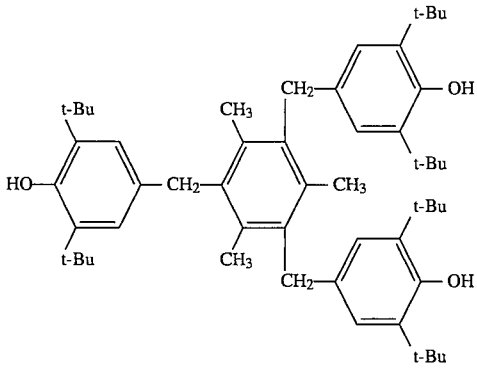

(XI)

Among the above, one represented by the formula (I) is most desirable in the present invention.

The phenol-based compound can be added at any step to the block copolymer used, and for example is added and kneaded during preparation of the block copolymer or at the same time with addition of an inorganic fine powder. It is sufficient that the block copolymer, the phenol-based compound and the inorganic fine powder have been uniformly kneaded upon spinning of the composite fiber of the present invention.

In the composite fiber of the present invention, the block copolymer incorporates, as described above, an inorganic fine powder. The amount of the inorganic fine powder to be added depends on the desired characteristics of the resulting fiber. However, since the present invention is to solve the problem associated with large incorporation of an inorganic fine powder, the block copolymer composition must contain at least 5% by weight of the inorganic fine powder based on the total weight of the composition and the fine powder. With an incorporation amount of less than by weight, the very problem to be solved by the invention disappears. There are no specific restrictions with respect to the upper limit of the incorporation amount, the amount is, nevertheless, preferably about not more than 85% by weight in view of spinnability, and more preferably in a range of 10 to 70% by weight.

The type of the inorganic fine powder to be incorporated varies depending on the intended fiber type. For example, to obtain an ultraviolet ray-shielding fiber, fine powders that reflect or absorb ultraviolet ray, i.e. those that do not substantially transmit ultraviolet ray are used. Representative examples of such fine powders are inorganic fine powders such as titanium dioxide, zinc oxide, magnesium oxide, alumina, silica, barium sulfate, calcium carbonate, sodium carbonate, talc and kaoline as they are and those having been subjected to various anti-aggregation treatments. These powders may be used singly or in combination.

Preferred among the above are titanium dioxide, zinc oxide and alumina, among which the most preferred is titanium dioxide. These powders are added in an amount as described above in view of ultraviolet ray-shielding effect. To obtain a brightly colored fiber, inorganic pigments are used as the inorganic fine powders. To obtain a conductive fiber, inorganic fine powders of conductive metal oxides or particulate metals are used. To obtain a magnetic fiber, magnetic powders, e.g. metals such as iron, cobalt and nickel and oxides of the foregoing and ferrite.

The inorganic fine powder used preferably has an average particle diameter of not more than 5μ, more preferably not more than 1μ. Too large a particle diameter causes the problems of filter clogging and filament breakage during spinning and also filament breakage upon drawing. The average particle diameter herein is measured with a particle size distribution tester (CAPA-500, made by Horiba, Ltd.)

In the present invention, the block copolymer containing an inorganic fine powder preferably further contains a metal salt of stearic acid or a titanium-based coupler, in particular magnesium, calcium or zinc salt of stearic acid, to increase threadability. Especially when the inorganic fine powder used comprises titanium dioxide, magnesium stearate is preferable. These compounds are added preferably in an amount of 1 to 10% by weight based on the weight of the inorganic fine powder.

Various processes are available for incorporating an inorganic fine powder into the block copolymer, including one which comprises kneading through a twin-screw kneading extruder or the like the block copolymer and the inorganic fine powder to obtain a master batch with high concentration, diluting it with the block copolymer to a prescribed concentration upon spinning and the spinning the diluted composition.

Where the block copolymer is kneaded with an inorganic fine powder, addition of various dispersing agents improves the dispersibility.

The composite fiber of the present invention is obtained by composite-spinning the above block copolymer containing an inorganic fine powder and a phenol-based compound as one component (hereinafter referred to as "component-B") and a fiber-forming thermoplastic polymer as the other component (hereinafter referred to as "component-A"). The composite fiber has a composite cross-sectional shape with at least 60% of its circumference occupied by component-A. If component-A occupied less than 60% of the fiber circumference, the large amount of component-B containing in inorganic fine powder and exposed on the surface will wear the guides an rolls during fiber formation process or after-processing such as weaving and cause filament breakage and like troubles.

A variety of composite configurations of component-A and component-B can be mentioned, representing ones being as shown in FIGS. 1 through 8.

Figure 2:
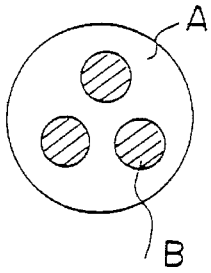
Figure 3:
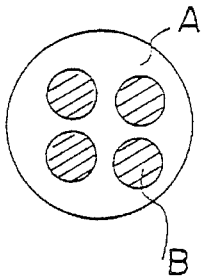
Figure 4:
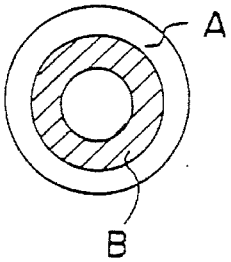
Figure 5:
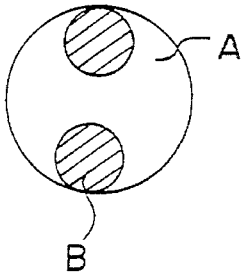
Figure 6:
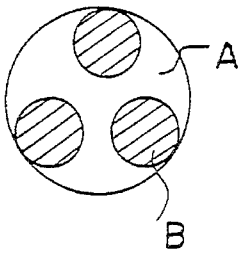
Figure 7:
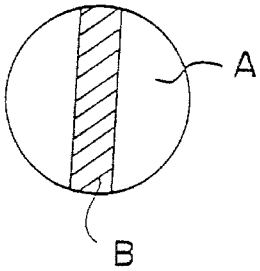
Figure 8:
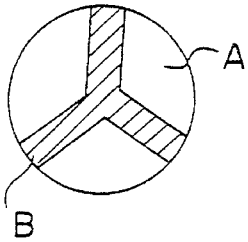

FIGS. 1, 2 and 3 show one-core, 3-core and 4-core type sheath-core composite fibers, respectively. FIG. 4 shows a 3-layer co-centric type. FIGS. 5 and 6 show sheath-core structure of partly exposed type. FIGS. 7 and 8 show split types. The configurations of FIGS. 7 and 8 may, depending on the combination of component-A and component-B, suffer delamination at the interface between the 2 components. The configurations of FIGS. 5 and 6 may not sufficiently solve the problem of wearing out of the guides and rolls used. Thus, desirable are those sheath-core structures as shown in FIGS. 1 through 4 in which the core component is completely covered with the sheath component. In these FIGURES, matched parts represent component-B and blank parts component-A.

It is preferred that the composite weight ratio between component-A and component-B be 20:80 to 80:20, more preferably 30:70 to 76:24. Too small an amount of component-A decreases the fiber strength, while too large an amount of component-A cannot sufficiently produces the effect of incorporation of an inorganic fine powder as contributed by coponent-B.

The component-A, i.e. the other component used in the invention is selected from the group consisting of polyamides, e.g. nylon 6, nylon 66, nylon 610, nylon 12, nylon 11, nylon 4 and nylon 46; polyesters, e.g. polyethylene terephthalate, polybutylene terephthalate and polyhexamethylene terephthalate; polyolefins, e.g. polyethylene and polypropylene and like thermoplastic polymers. In consideration of fibers properties, preferred are polyesters principally comprising polyethylene terephthalate or polybutylene terephthalate and polyamides principally comprising nylon 6 or nylon 66. These polymers may comprise a small amount of a copolymerization component. Examples of preferred polyesters are fiber-forming ones synthesized from an aromatic, aliphatic or alicyclic dicarboxylic acid such as terephthalic acid, isophthalic acid, naphthalene-2,5-dicarboxylic acid, α,β-(4-carboxyphenoxy)ethane, 4,4'-dicarboxydiphenyl, alkylene oxide adducts of bisphenol-A, adipic acid, azelaic acid and sebacic acid, in combination with a diol such as ethylene glycol diethylene glycol, 1,4-butanediol, 1,6-hexanediol, neopentyl glycol, cyclohexane-1,4-dimethanol, polyethylene glycol or polytetramethylene glycol, and/or an oxycarboxylic acid such as hydroxybenzoic acid. Preferred among these are polyesters comprising at least 80% in particular at least 90%, of the constituting units of ethylene terephthalate units or butylene terephthalate units. These polymers may contain small amounts of a fluorescent agent, stabilizer and like additives.

To improve the dyeability and provide its color with brightness of a textile product comprising a fiber containing a large amount of an inorganic fine powder, it is preferable to select as component-A a polyester obtained by copolymerizing a difunctional monomer comprising an aromatic group with an $—SO_3M$ group (M represents a hydrogen atom, a metal atom or an alkylphosphonium group) bonded thereto. The difunctional monomer may be a dicarboxylic acid or its derivatives, a diol or an oxycarboxylic acid.

Examples of the aromatic group to which the $—SO_3M$ group bonds are benzenetriyl, naphthalenetriyl, anthrathenetriyl, diphenyltriyl, oxydiphenyltriyl, sulfodiphenyltriyl and methylenediphenyltriyl. Examples of the M being a metal atom are sodium, potassium, magnesium, calcium, copper and iron. Examples of the M being an alkylphosphonium group are tetrabutylphosphonium group, ethyltributylphosphonium group, benzyltributylphosphonium group, tetraphenylphosphonium group, phenyltibutylphosphonium group and benzyltriphenylphosphonium group.

The ratio of copolymerization with the above difunctional monomer having an $—SO_3M$ group is, for the difunctional monomer being a dicarboxylic acid or its derivatives preferably at least 1.0 mole % based on the total carboxylic acids constituting the polyester, more preferably at least 1.5 mole % on the same basis. The same indexes apply also with the difunctional monomer being a diol, based on the total diols constituting the polyester; and with the difunctional monomer being an oxycarboxylic acid, based on either one of the total dicarboxylic acids or total diols constituting the polyester. With the ratio being less than 1.0 mole %, colors with sufficient brightness cannot be obtained.

Use of a polyester obtained by copolymerization of a difunctional monomer having an $—SO_3M$ group as component-A realizes, when textiles comprising the resulting composite fiber are dyed with cationic dyes, bright colors having high-grade feeling. The ratio of copolymerization however is preferably not more than 5.5 mole %, since otherwise the fiber properties, in particular strength, would decrease. In the present invention, the desired copolymerization amount may be achieved by mixing a polyester having a high copolymerization ratio with one having a low copolymerization ratio.

The composite fiber of the present invention is obtained by a process which comprises the successive steps of separately heat melting component-A and component-B, feeding the two melts through separate paths toward a spinneret capable of forming the desired composite configuration, joining the two just before the spinneret, extruding the joined melt therethrough, taking up or storing in a can the extruded melts, and drawing and heat treating the as-spun fiber. Also available are a process which comprises directly drawing the as-spun fiber without taking it up or storing it in a can or a process which comprises extruding through a spinneret and taking up the extruded melts at a high speed without further drawing. Post-processings such as crimping and false twisting may also be applied.

The present invention solves problems encountered upon production of a fiber having a fineness of not more than 8 deniers from a polymer containing a large amount of an inorganic fine powder, that is, the problem of poor spinnability. In the production of fibers having a fineness of more than 8 deniers, the problems to be solved by the invention themselves therefore do not exist. In the present invention, particularly significant effect is produced where it is attempted to obtain fibers having a fineness of not more than 5 deniers.

The composite fiber of the present invention may either be a continuous yarn or short cut fiber. The composite fiber of the present invention may be formed to have a polygonal cross-sectional shape, such as pentagon or hexagon, by higher order processings such as false-twist-crimping or may have, besides circular, an irregular cross-sectional shape such as tri-lobal, T-shaped, tetra-lobal, octa-lobal and other shapes than circular. Further the component-B in the sheath-core structures shown in FIGS. 1 through 6 may assume, besides circular, an irregular cross-sectional shape other than circular. In short, fibers satisfying the requirements so far described can achieve the object of the present invention. Particularly excellent effects are produced, in the present invention, when as an inorganic fine powder that capable of absorbing or reflecting ultraviolet ray is used. This is because that, in order to obtain a fiber having sufficient shielding function for ultraviolet ray, a large amount of the above fine powder should be used and that the fiber is, when used for clothing, preferably as fine as conventional fibers for clothing, for example not more than 3 deniers. The composite fiber of the present invention is markedly suitable for this purpose.

The composite fiber of the present invention can be used singly or in combination with other fibers for the production of woven, knit and nonwoven fabrics which are used in a wide variety of fields. When used in combination with other fibers, the combining process includes combined yarn preparation, fiber blending, yarn doubling, co-twisting, union cloth weaving, union cloth knitting or like known processes. The composite fiber of the present invention can be dyed in the form of fiber, yarns or various textiles.

Where the composite fiber of the present invention is one shielding ultraviolet ray, examples of its suitable form are, for short cut fiber, staple for clothing use, dry laid nonwoven fabrics, wet laid nonwoven fabrics and the like, and, for continuous yarn, various woven and knit fabrics. Concrete examples of the end-use are wears for open-air sports such as soccer and golf, T-shirts, polo shirts, outdoor sports wears, e.g. marathon wear, beach wear, swimming wear, caps, blouses, veils, stockings, gloves, hoods, curtains, slats for blinds, parasols, tents and agricultural shielding materials. In these cases, the composite fiber of the present invention may be used after being dyed.

EXAMPLES

Other features of the invention will become apparent in the course of the following descriptions of exemplary embodiments which are given for illustration of the invention and are not intended to be limiting thereof.

In the Examples that follow, the property of shielding ultraviolet ray was evaluated according to the following method.

A sample fiber of a multifilament yarn having a fineness of 75 deniers is prepared. The multifilament yarn is woven into a plain fabric having a warp density of 95 pieces/inch and a weft density of 60 pieces/inch, which is then scoured and tested for evaluation. For the evaluation, the ultraviolet ray transmittance of a specimen fabric is determined with a ultraviolet ray intensity integrator made by Toray Techno Co. as follows. A specimen is placed on the center of the ultraviolet ray intensity integrator. Ultraviolet ray is irradiated on the specimen and also, at the same time and separately, on another ultraviolet ray intensity integrator. The ultraviolet ray transmittance is:

$$\text{Ultraviolet ray transmittance (\%)} = 100 \times (U/U_0)$$

where:

U=amount of ultraviolet ray of the specimen side and $U_0$=amount of ultraviolet ray of the blank Lower ultraviolet ray transmittance means better shielding performance.

In the Examples, the stability of fiber formation operation is expressed by the grade-A ratio in spinning and drawing processes, which are calculated as:

$$\text{Grade-}A\text{ ratio} = 100 \times \frac{\text{(number of bobbins with no fluff or yarn breakage)}}{\text{(number of total bobbins)}}$$

wherein the number of total bobbins are those obtained upon one-week continuous operation while each bobbin is doffed 2 hours after start winding and, upon yarn breakage, the then winding bobbin is replaced by a new bobbin.

Higher grade-A ratio means better process stability.

Reference Example

An autoclave dried and substituted with nitrogen was charged, while a solvent of cyclohexane, a polymerization catalyst of n-butyl lithium and a vinylization agent of N,N,N',N'-tetramethylethylenediamine were used, with styrene. monomer, isoprene or butadiene monomer and styrene monomer successively in this order, to effect polymerization several times. The tri-block copolymers thus obtained were hydrogenated in cyclohexane in the presence of a hydrogenation catalyst of Pd-C and under a hydrogen pressure of 20 kg/cm$^2$, to give block copoylmers having molecular characteristics as shown in Table 1.

TABLE 1

| Tri-block copolymer | (a) | (b) | (c) | (d) | (e) |
|---|---|---|---|---|---|
| Number-average molecular weight | 100,000 | 100,000 | 60,000 | 50,000 | 50,000 |
| Number-average molecular weight of polystyrene block | 15,000 | 6,500 | 9,000 | 22,000 | 3,000 |
| Number-average molecular weight of polyisoprene block | 70,000 | 87,000 | 42,000 | 6,000 | 44,000 |
| Hydrogenation ratio (%) | 99.0 | 99.0 | 99.0 | 99.0 | 20 |
| Weight ratio of polystyrene block/polyisoprene block | 30/70 | 13/87 | 30/70 | 30/70 | 30/70 |
| MFR (g/10 min) | 20 | 30 | 80 | 10 | 100 |

Example 1

To 38 parts by weight of a block copolymer (a) containing 0.3% by weight of a hydroxy-tert-butylphenyl compound represented by formula (I), there were added 60 parts by weight of titanium dioxide having an average particle diameter of 0.4 μm (made by Titan Kogyo K.K.; ultraviolet ray-shielding function: nearly zero transmittance) and 2 parts by weight of magnesium stearate. The mixture thus obtained was extrusion-kneaded through a twin-screw extruder at a temperature of 230° C. into strands, which were then cut to give pellets.

The thus obtained pellets of the block copolymer (a) containing titanium dioxide were melt-kneaded with pellets of the same block copolymer containing no titanium dioxide in a ratio by weight of 1:1 to give a composition, which was, as component-B, the fed to an extruder. Separately, as component-A, a polyethylene terephthalate (intrinsic viscosity: 0.65 dl/g) containing 0.05% by weight of titanium dioxide was fed to another extruder. Melts from the two extruders were joined in a spinneret at a spinning temperature of 295° C. such that component-A and component-B constitute the sheath component and the core component, respectively, with a composite ratio by weight, A:B, of 2:1 and a cross-sectional configuration as shown in FIG. 1, and extruded through the spinneret and taken up at a spinning speed of 1,000 m/min.

The as-spun fiber thus obtained was drawn at a hot roll temperature and plate temperature of 75° C. and 140° C. respectively and in a drawing ratio. of 3.4, to give a multifilament yarn of 75 deniers/24 filaments. The core-constituting component of the single filaments of the multifilament yarn was extracted with toluene and checked for the molecular weight distribution, which was found to be almost the same as that of the raw material. From this fact, it was confirmed that the MFR had not changed. The cross-sectional configuration of the single filaments of the multifilament yarn were observed under a microscope. The sheath-core ratio was nearly constant in any filament sample and also in the longitudinal direction thereof, with the core component being completely covered with the sheath component. The multifilament yarn showed excellent uniformity and had no fluffs.

The drawn multifilament yarn was woven into a plain fabric having a warp density of 95 pieces/inch and weft density of 60 pieces/inch, which was then scoured and subjected to evaluation. In the above production processes, the grade-A ratio in the spinning was 98% and that in the drawing was 93%, which were excellent. The yarn exhibited good processability both during weaving and thereafter. The fabric was tested for ultraviolet ray-shielding property, which was found to be excellent.

Comparative Example 1

An attempt was made to obtain a composite fiber by repeating Example 1 except that the hydroxy-tert-butylphenyl compound was not contained in component-B at all. However, the component-B polymer decomposed in the spinning pack used, and the decomposition gas caused bubbles in the extruded streams, whereby filament breakage occurred frequently during spinning and satisfactory as-spun fiber could not be obtained in a high yield.

Examples 2 through 8

Example 1 was repeated except that the conditions shown in Table 2 were employed. The operation was stable and the obtained fibers had good cross-sectional shape and uniformity, as well as good ultraviolet ray-shielding property.

Examples 9 through 13

Example 1 was repeated several times except that: in Examples 9 and 10 polybutylene terephthalate and nylon 6 were used as component-A, respectively, and in Examples 11, 12 and 13, there were used as a hydroxy-tert-butylphenyl compound, a compound of formula (II), that of formula (III) and that of formula (IV), respectively; and th&t the as-spun fibers were directly drawn without being once taken up, to obtain multifilament yarns of 75 deniers/24 filaments. The cross-sections of the single filaments of each of the multifilament yarns thus obtained were observed under a microscope. Any filament of each of the multifilament yarns had nearly the same sheath-core ratio, same as the fiber of Example 1. The multifilament yarns were uniform and had no fluffs.

Comparative Example 2

Example 1 was repeated except that titanium dioxide was not incorporated into component-B, to obtain a multifilament yarn of 75 deniers/24 filaments, which was then woven into a plain fabric in the same manner. The fabric was tested for ultraviolet ray transmittance. The fabric had a considerably lower ultraviolet ray-shielding property than that obtained in Example 1. Long-sleeve shirts were prepared using the fabrics of Example 1 and Comparative Example 2 for the left side and the right side, respectively. Five panelists wore these shirts alone on the upper half of their body and were exposed to sunlight for an integrated time of 50 hours. The results of the test are shown in Table 3.

The fabrics of Example 1 and Comparative Example 2 were each used to prepare a parasol. The parasols were tested for ultraviolet ray transmittance, to shown nearly the same values as in Table 1.

Also, the fabrics of Example 1 and Comparative Example 2 were each used to prepare a cap having the same specification. The cap from the fabric of Example 1 was when worn for a long period of time under a direct sunlight, felt less stuffy on the head and more comfortable than that of Comparative Example 2.

Examples 14 through 18

Example 1 was repeated several times except that inorganic fine powders as shown in Table 2 were used, that is, Example 14 used 15% by weight of a titanium dioxide having an average particle diameter of 0.4 μm (transmits no ultraviolet ray at all) and 15% by weight of a zinc oxide having an average particle diameter of 0.5 μm (transmits no ultraviolet ray at all);

Example 15 used 20% by weight of the above zinc oxide;

Example 16 used 15% by weight of the above titanium dioxide and a barium sulfate having an average particle diameter of 0.5 μm (hardly transmits ultraviolet ray);

Example 17 used 15% by weight of the above titanium dioxide and 15% by weight of silica having an average particle diameter of 0.1 μm (hardly transmits ultraviolet ray); and Example 18 used 15% by weight of the above titanium dioxide and 15% by weight of alumina having an average particle diameter of 0.5 μm (hardly transmits ultraviolet ray).

The results are shown in Table 2.

TABLE 2

| | Inorganic fine powder | | Spinning conditions | | Operation stability | | | | |
|---|---|---|---|---|---|---|---|---|---|
| | | Amount added (% by weight) | Composite ratio (A/B) | Cross-sectional shape | Spinnability Grade-A ratio | Drawability Grade-A ratio | After-process-ability | UV trans-mittance | Overall evalua-tion |
| Ex. 1 | Titanium dioxide | 30 | 67/33 | FIG. 1 | 98 | 93 | ○ | 2.7 | ○ |
| Ex. 2 | Titanium dioxide | 20 | " | " | 99 | 93 | ○ | 5.3 | ○ |
| Ex. 3 | Titanium dioxide | 50 | " | " | 96 | 90 | ○ | 2.1 | ○ |
| Ex. 4 | Titanium dioxide | 30 | 50/50 | " | 98 | 91 | ○ | 2.5 | ○ |
| Ex. 5 | Titanium dioxide | 30 | 75/25 | " | 99 | 95 | ○ | 4.5 | ○ |
| Ex. 6 | Titanium | 30 | 67/33 | FIG. 2 | 98 | 93 | ○ | 2.8 | ○ |

TABLE 2-continued

| | Inorganic fine powder Amount added (% by weight) | | Spinning conditions Composite ratio (A/B) | Cross-sectional shape | Operation stability Spinnability Grade-A ratio | Drawability Grade-A ratio | After-process-ability | UV trans-mittance | Overall evalua-tion |
|---|---|---|---|---|---|---|---|---|---|
| | dioxide | | | | | | | | |
| Ex. 7 | Titanium dioxide | 30 | " | FIG. 3 | 98 | 93 | o | 2.7 | o |
| Ex. 8 | Titanium dioxide | 30 | " | FIG. 4 | 98 | 94 | o | 2.5 | o |
| Ex. 9 | Titanium dioxide | 30 | " | FIG. 1 | 98 | 91 | o | 3.1 | o |
| Ex. 10 | Titanium dioxide | 30 | " | " | 98 | 92 | o | 3.3 | o |
| Ex. 11 | Titanium dioxide | 30 | " | " | 98 | 92 | o | 3.1 | o |
| Ex. 12 | Titanium dioxide | 30 | " | " | 98 | 92 | o | 3.1 | o |
| Ex. 13 | Titanium dioxide | 30 | " | " | 91 | — | o | 3.0 | o |
| Ex. 14 | Titanium dioxide | 15 | " | " | 98 | 92 | o | 2.8 | o |
| | zinc oxide | 15 | | | | | | | |
| Ex. 15 | Zine oxide | 20 | " | " | 98 | 93 | o | 4.8 | o |
| Ex. 16 | Titanium dioxide | 15 | " | " | 95 | 90 | o | 5.5 | o |
| | Barium sulfate | 15 | | | | | | | |
| Ex. 17 | Titanium dioxide | 15 | " | " | 98 | 92 | o | 7.5 | o |
| | Silica | 15 | | | | | | | |
| Ex. 18 | Titanium dioxide | 15 | " | " | 98 | 90 | o | 7.5 | o |
| | Alumina | 15 | | | | | | | |
| Comp. Ex. 1 | Titanium dioxide | 30 | 67/33 | FIG. 1 | 50 | 40 | — | — | x |
| Comp. Ex. 2 | — | 0 | " | " | 99 | 96 | o | 22.5 | x |

TABLE 3

| Panel-ist | Sunbarn Example 1 | Sunbarn Comp. Ex. 2 | Wearing feeling Example 1 | Wearing feeling Comp. Ex. 2 |
|---|---|---|---|---|
| A | Fairly mild | Fairly serious | Good | Rather hot |
| B | Mild | Serious | " | " |
| C | Fairly mild | Fairly serious | " | " |
| D | " | " | Fairly good and little fatigued | Hot and much fatigued |
| E | " | " | Fairly good and little fatigued | Hot and much fatigued |

Examples 19 and 20

Example 1 was repeated except that block copolymer (b) was used (Example 19) or block copolymer (c) was used (Example 20) as a component-B polymer, to obtain multifilament yarns of 75 deniers/24 filaments. The cross sections of the filaments constituting each of the multifilament yarns were observed under a microscope. It was found that they were nearly the same in the same multifilament yarn and markedly uniform. No fluffs were observed. The results are shown in Table 4.

Comparative Examples 3 and 4

Example 1 was repeated except that block copolymer (d) was used (Comparative Example 3) or block copolymer (e) was used (Comparative Example 4) as a component-B polymer, in an attempt to obtain multifilament yarns of 75 deniers/24 filaments. In both cases, the component-B polymers decomposed seriously and fiber formation was impossible. These results are expressed by "X" in Table 4.

TABLE 4

| | A-compo-nent polymer | B-compo-nent polymer | Spinning conditions Compos-ite ratio (A/B) | Cross-sectional shape | Operation stability Spinn-ability Grade-A ratio | Draw-ability Grade-A ratio | After-process-ability | UV trans-mittance | Overall evalua-tion |
|---|---|---|---|---|---|---|---|---|---|
| Example 1 | PET* | Block copoly-mer (a) | 67/33 | FIG. 1 | 98 | 93 | o | 2.7 | o |
| Example 19 | " | Block copoly- | 67/33 | " | 95 | 91 | o | 2.8 | o |

TABLE 4-continued

| | A-component polymer | B-component polymer | Spinning conditions: Composite ratio (A/B) | Spinning conditions: Cross-sectional shape | Operation stability: Spinnability Grade-A ratio | Operation stability: Drawability Grade-A ratio | After-processability | UV transmittance | Overall evaluation |
|---|---|---|---|---|---|---|---|---|---|
| | | mer (b) | | | | | | | |
| Example 20 | " | Block copolymer (c) | 67/33 | " | 93 | 90 | ○ | 2.9 | ○ |
| Comparative Example 3 | " | Block copolymer (d) | 67/33 | " | — | — | — | — | x |
| Comparative Example 4 | " | Block copolymer (e) | 67/33 | " | — | — | — | — | x |

*Polyethylene terephthalate

Example 21

Example 1 was repeated except that a polyethylene terephthalate having copolymerized 1.7 mole % of 5-sulfoisophthalic acid dimethyl ester sodium salt and containing 0.05% by weight of titanium dioxide as component-A, to obtain a multifilament yarn of 75 deniers/24 filaments. The core-constituting component of the single filaments of the multifilament yarn was extracted with toluene and checked for the molecular weight distribution, which was found to be almost the same as that of the raw material. From this fact, it was confirmed that the MFR had not changed. The cross-sectional configuration of the single filaments of the multifilament yarn were observed under a microscope. The sheath-core ratio was nearly constant in any filament sample and also in the longitudinal direction thereof, with the core component being completely covered with the sheath component. The multifilament yarn showed excellent uniformity and had no fluffs.

The drawn multifilament yarn was woven into a plain fabric having a warp density of 95 pieces/inch and weft density of 60 pieces/inch, which was then scoured and subjected to evaluation. In the above production processes, spinnability, drawability and processabilities during weaving and thereafter were all good. The fabric was tested for ultraviolet ray-shielding property, which was found to be excellent.

The plain fabric obtained was dyed with a cation dye under the following conditions.

| | |
|---|---|
| Cation Brill Red 4GH | 2% owf |
| $Na_2SO_4$ | 2 g/l |
| Acetic acid (glacial acetic acid) | 1% owf |
| Sodium acetate | 0.5% owf |
| Bath ratio 50:1 | 120° C. × 1 hour |

The thus dyed fabric developed markedly bright color as compared with that with a disperse dye of Comparative Example 5 which is described next.

Comparative Example 5

Example 21 was repeated except that polyethylene terephthalate containing 0.05% of titanium dioxide, to obtain a multifilament yarn, which was then woven into a plain weave in the same manner. The plain fabric thus obtained was dyed with a disperse dye under the following conditions.

| | |
|---|---|
| Sumikaron Red SE-RPD | 2% owf |
| Dispersing agent (Nikka Sansolt#7000) | 0.5 g/l |
| pH adjusting agent: | |
| ammonium sulfate | 1 g/l |
| acetic acid (48%) | 1 cc/l |
| Bath ratio 50:1 | 130° C. × 1 hr |

The color development as represented by brightness was poor as compared with Example 21.

Comparative Example 6

Example 21 was repeated except that no hydroxy-tert-butylphenyl compound was contained in component-B, with an intention to obtain a fiber. However, the component-B polymer decomposed in the spinning pack used, and the decomposition gas caused bubbles in the extruded streams, whereby filament breakage occurred frequently during spinning and satisfactory as-spun fiber could not be obtained in a high yield.

Examples 22 through 28

Example 21 was repeated except that the conditions shown in Table 5 were employed. The operation was stable and the obtained fibers had good cross-sectional shape and uniformity, as well as good ultraviolet ray-shielding property. The dyed fabrics had excellent color brightness.

Examples 29 through 33

Example 21 was repeated several times except that: Examples 29 and 30 used as component-A polyethylene terephthalates having 2.5 mole % and 4.5 mole % of a copolymerization component of 5-sulfoisophthalic acid dimethyl ester sodium salt, respectively, and Examples 31, 32 and 33 used, as a hydroxy-tert-butylphenyl compound, compound (II), compound (III) and compound (IV), respectively; and that the as-spun fibers were directly drawn without being once taken up, to obtain multifilament yarns of 75 deniers/24 filaments, which were then woven into fabrics and then dyed in the same manner. The cross-sections of the single filaments of each of the multifilament yarns thus obtained were observed under a microscope. Any single filament of each of the multifilament yarns had nearly the same sheath-core ratio, same as the fiber of Example 21.

The multifilament yarns were markedly uniform and had no fluff. The dyed fabrics had an excellent bright color.

Comparative Example 7

Example 21 was repeated except that titanium dioxide was not incorporated into component-B, to obtain a multifilament yarn of 75 deniers/24 filaments, which was then woven into a plain fabric in the same manner. The fabric was tested for ultraviolet ray transmittance. They ultraviolet ray-shielding property was considerably lower than the fabric of Example 21. The fabric showed, when dyed in the same manner as in Example 21, excellent color brightness.

Examples 34 through 38

Example 21 was repeated several times except that inorganic fine powders as shown in Table 5 were used, that is:

Example 34 used 15% by weight of a titanium dioxide having an average particle diameter of 0.4 μm (transmits no ultraviolet ray at all) and 15% by weight of a zinc oxide having an average particle diameter of 0.5 μm (transmits no ultraviolet ray at all);

Example 35 used 20% by weight of the above zinc oxide;

Example 36 used 15% by weight of the above titanium dioxide and a barium sulfate having an average particle diameter of 0.5 μm (hardly transmits ultraviolet ray);

Example 37 used 15% by weight of the above titanium dioxide and 15% by weight of silica having an average particle diameter of 0.1 μm (hardly transmits ultraviolet ray); and Example 38 used 15% by weight of the above titanium dioxide and 15% by weight of alumina having an average particle diameter of 0.5 μm (hardly transmits ultraviolet ray).

The results are shown in Table 5.

Comparative Example 8

An attempt was made to repeat Example 21 except for using block copolymer (e). However, the component-B polymer decomposed seriously and fiber formation was impossible.

Obviously, numerous modifications and variations of the present invention are possible in light of the above teachings. It is therefore understood that within the scope of the appended claims, the invention may be practiced otherwise than as specifically described herein.

TABLE 5

| | Inorganic fine powder; Amount added (% by weight) | | Spinning conditions: Composite ratio (A/B) | Spinning conditions: Cross-sectional shape | Operation stability: Spinnability | Operation stability: Drawability | After-processability | UV transmittance | Brightness of color of dyed fabric | Overall evaluation |
|---|---|---|---|---|---|---|---|---|---|---|
| Example 21 | Titanium dioxide | 30 | 67/33 | FIG. 1 | o | o | o | 3.0 | good | o |
| Example 22 | " | 20 | " | " | o | o | o | 5.1 | " | o |
| Example 23 | " | 50 | " | " | o | o | o | 2.0 | " | o |
| Example 24 | " | 30 | 50/50 | " | o | o | o | 2.4 | " | o |
| Example 25 | " | " | 75/25 | " | o | o | o | 4.0 | " | o |
| Example 26 | " | " | 67/33 | FIG. 2 | o | o | o | 2.9 | " | o |
| Example 27 | " | " | " | FIG. 3 | o | o | o | 2.9 | " | o |
| Example 28 | " | " | " | FIG. 4 | o | o | o | 2.9 | " | o |
| Example 29 | " | " | " | FIG. 1 | o | o | o | 3.1 | " | o |
| Example 30 | " | " | " | " | o | o | o | 3.1 | " | o |
| Example 31 | " | " | " | " | o | o | o | 2.9 | " | o |
| Example 32 | " | " | " | " | o | o | o | 3.0 | " | o |
| Example 33 | " | " | " | " | o | o | o | 2.9 | " | o |
| Example 34 | Titanium dioxide<br>Zinc oxide | 15<br>15 | " | " | o | o | o | 2.8 | " | o |
| Example 35 | Zinc oxide | 20 | " | " | o | o | o | 5.6 | " | o |
| Example 36 | Titanium dioxide<br>Barium sulfate | 15<br>15 | " | " | o | o | o | 5.6 | " | o |
| Example 37 | Titanium dioxide<br>Silica | 15<br>15 | " | " | o | o | o | 7.9 | " | o |
| Example 38 | Titanium dioxide<br>Alumina | 15<br>15 | " | " | o | o | o | 7.7 | " | o |
| Comparative Example 5 | Titanium dioxide | 30 | 67/33 | FIG. 1 | o | o | o | 2.7 | bad | x |
| Comparative Example 6 | " | " | " | " | x | — | — | — | — | x |
| Comparative Example 7 | — | 0 | " | " | o | o | o | 23.0 | good | x |
| Comparative Example 8 | Titanium dioxide | 30 | " | " | x | — | — | — | " | x |

What is claimed is:

1. A composite fiber having a single fiber fineness of not more than 8 deniers and comprising a sheath comprising a protective polymer component (A) and a core comprising a polymer component (B), said component (A) being exposed on at least 60% of a circumference of a cross-section of said fiber, said protective polymer component (A) comprising a fiber-forming thermoplastic polymer and said polymer component (B) containing an inorganic fine powder, said component (B):

(I) containing said inorganic fine powder in an amount of 5 to 85% by weight based on total weight of component (B), (II) containing as a sole spin enhancer at least 0.1% by weight based on the weight of the polymer constituting component (B) of a hydroxy-tert-butylphenyl compound with its hydroxy group present at the ortho-position relative to the tert-butyl group, and (III) comprising a block copolymer, said block copolymer having a number average molecular weight of 30,000 to 250,000 and comprising units of poly(vinylaromatic) block having a number average molecular weight of 4,000 to 50,000 and units of a poly(conjugated diene) block having a number average molecular weight of 10,000 to 150,000, at least 30% of the double bonds based on the conjugated diene of said poly(conjugated diene) block being hydrogenated, wherein said block copolymer has a melt flow rate of at least 5 g/10 min.

2. A composite fiber according to claim 1, wherein said poly(vinylaromatic) block is contained in said block copolymer in an amount of 5 to 80% by weight.

3. A composite fiber according to claim 1, wherein a block copolymer is a polystyrene-polyisoprene-polystyrene triblock copolymer.

4. A composite fiber according to claim 1, wherein a composite ratio between said protective polymer component (A) and said polymer component (B) containing an inorganic fine powder is in a range of from 20:80 to 80:20.

5. A composite fiber according to claim 1, wherein said protective polymer component (A) comprises a polyester.

6. A composite fiber according to claim 1, wherein said protective polymer component (A) comprises a polyester having a copolymerized a difunctional monomer comprising an aromatic group with an $—SO_3M$ group bonded thereto, wherein M is any one of an hydrogen atom, a metal atom and an alkylphosphonium group.

* * * * *